United States Patent [19]

Janson

[11] 3,986,536

[45] Oct. 19, 1976

[54] GROUT INJECTING APPARATUS

[75] Inventor: Leroy W. Janson, Clarks Green, Pa.

[73] Assignee: Sprague & Henwood, Inc., Scranton, Pa.

[22] Filed: June 16, 1975

[21] Appl. No.: 587,109

[52] U.S. Cl. ..... 141/311 R; 141/392; 61/35; 61/63; 222/321

[51] Int. Cl.[2] ..... B65B 3/04

[58] Field of Search ..... 61/63, 35; 175/2, 4, 175/58, 59, 100, 226, 239, 240, 244–249, 385, 387; 166/291; 141/392, 311; 222/321, 309

[56] References Cited

UNITED STATES PATENTS 3,194,447 7/1965 Brown ..... 222/321

*Primary Examiner*—Houston S. Bell, Jr.

*Attorney, Agent, or Firm*—Z. T. Wobensmith, 2nd; Z. T. Wobensmith, III

[57] ABSTRACT

Apparatus is described for injecting grout or cementitious material into a small diameter hole which has been bored in the soil at a depth below a larger diameter hole for the purpose of obtaining an intact sample of soil and/or rock formation. The smaller diameter or second hole has a hollow rod from the apparatus inserted into it and grout injected through it and thereearound into contact with the soil. The rod is detached from the apparatus which is removed and the mass of soil, rod and grout is recovered by overboring in a conventional manner.

10 Claims, 5 Drawing Figures

GROUT INJECTING APPARATUS

The foregoing abstract is not to be taken as limiting the scope of my invention and in order to understand the full nature and extent of the technical disclosure of this patent reference must be made to the accompanying drawings and the following detailed description.

BACKGROUND OF THE INVENTION

1. Field of the Invention

This invention relates to a grout injecting apparatus of the self-contained type that carries its charge of grout to the location where it is to be discharged.

2. Description of the Prior Art

The recovery of complete core samples from certain types of soil is very difficult and not easily obtainable in a conventional manner as the samples often crumble. An accepted practice for obtaining a good soil sample under adverse soil conditions is described in the U.S. Pat. to Manuel Coelho Mendes da Rocha No. 3,631,934. In the da Rocha patent a large diameter hole is bored to a depth where sampling is to begin and a smaller diameter hole is bored to the desired depth for the core sample. The second hole is filled with grout by gravity flow or pressure pumping from the surface and a reinforcing member is placed therein.

A core drill is then placed in the larger diameter hole and a sample is overcored which sample extends around the reinforcing member and to the desired depth.

While this method of obtaining a core sample is satisfactory, no wholly satisfactory apparatus for injecting grout into the second hole and placing a reinforcing member therein has been provided which is accomplished at one time. In addition the grout to be pumped or gravity flowed is very thin and does not possess desired binding characteristics. The apparatus of my invention provides structure to inject grout and introduce a reinforcing member into the second hole all in one operation with thick grout being utilized if desired.

SUMMARY OF THE INVENTION

This invention relates to apparatus for injecting grout or cementitious materials into a hole in conjunction with a reinforcing member which mass forms the center of a core sample that may be cut out of the soil or rock and retrieved.

The principal object of the invention is to provide apparatus for injecting grout that quickly and positively places the grout at the desired location.

A further object of the invention is to provide apparatus for injecting grout that can be charged at the surface of the ground.

A further object of the invention is to provide apparatus for injecting grout that has a long service life.

A further object of the invention is to provide apparatus for injecting grout which can carry a varying volume and density of grout as desired.

Other objects and advantageous features of the invention will be apparent from the description and claims.

DESCRIPTION OF THE DRAWINGS

The nature and characteristic features of the invention will be more readily understood from the following description taken in connection with the accompanying drawings forming part hereof, in which.

It should, of course, be understood that the description and drawings herein are illustrative merely and that various modifications and changes can be made in the structure disclosed without departing from the spirit of the invention.

Like numerals refer to like parts throughout the several views.

DESCRIPTION OF THE PREFERRED EMBODIMENT

Figure 1:
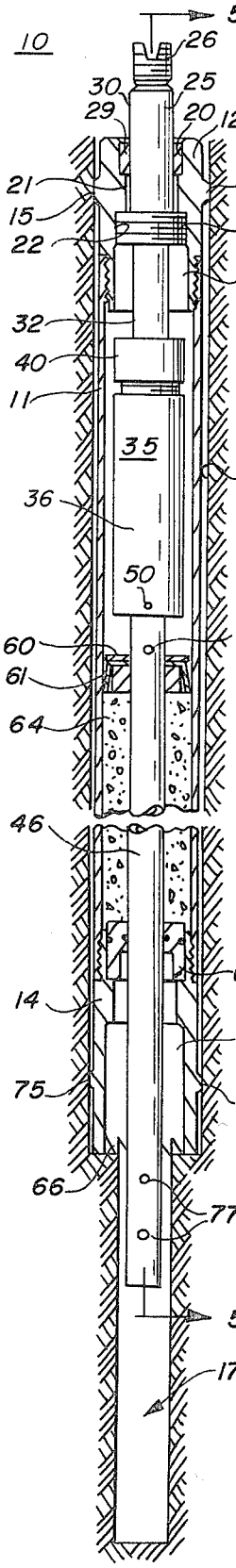
FIG. 1 is a vertical central sectional view showing a hole in the soil with the apparatus of the invention therein in one position.

Referring now more particularly to the drawings the apparatus of my invention includes a grout emplacement assembly 10 which includes a central hollow outer tube 11 open at the ends with threaded internal portions at each end, with the upper end, as seen in FIG. 1, closed by a detachable plug 12 and the lower end closed by a detachable head 14.

The plug 12 is of cylindrical configuration and has a plurality of orienting teeth 15 on the outside engaging the bore hole 16 and which centralize the assembly 10 in the bore hole 16 but allow passage of fluid thereby.

The plug 12 has an upper bore 20, an intermediate bore 21 of lesser diameter, a threaded portion 22 abutting the bore 21 of larger diameter, and a bore 23 abutting portion 22 of larger diameter than threaded portion 22.

An orienting tube 25 of well known type as illustrated in the Mendes da Rocha U.S. Pat. No. 3,631,934 is carried in the bore 20 which tube 25 has an upper threaded portion 26 engaged by a hollow rod 27 which extends to the surface of the ground to equipment (not shown) for rotating, raising and lowering the assembly 10 in bore hole 16 and also for introducing grout into the rod for purposes to be described.

The rod 25, below the threaded portion 26 has a smooth portion 30 guided by a bearing sleeve 29 in the bore 20, and extending within the bore 21, with a threaded portion 31 engaged with the threaded portion 22 of plug 12 in the position shown in FIG. 1.

The rod 25 below the threaded portion 31 has a smooth portion 32 which is carried in a shear head assembly 35.

Figure 5:
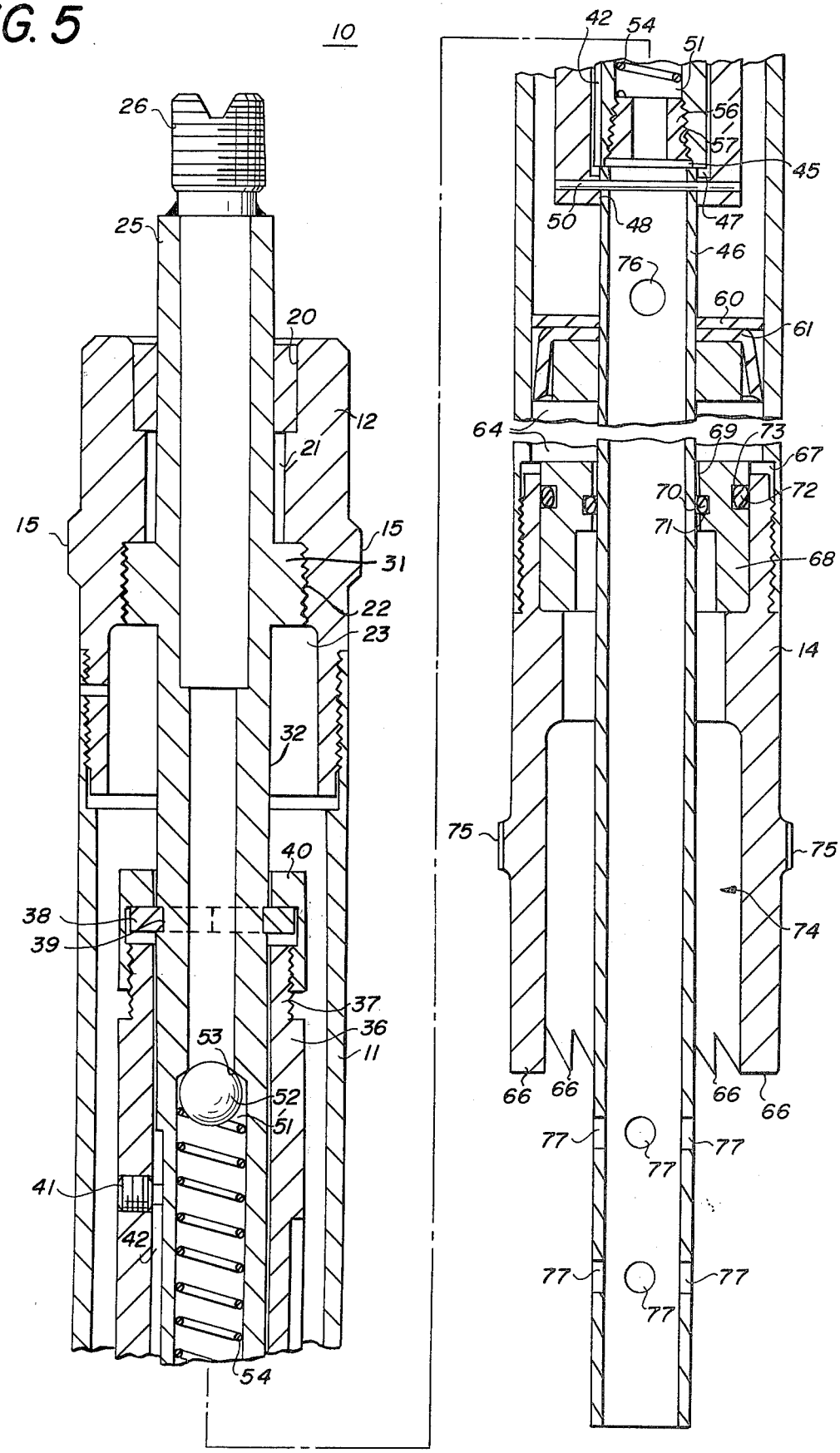
FIG. 5 is a vertical sectional view, enlarged, taken approximately on the line 5—5 of FIG. 1.

The assembly 35 includes a hollow outer tube 36 threaded at its upper end 37, as seen in FIG. 5, with the rod 25 extending therein and retained by two half rings 38 engaged in a groove 39 in portion 32 of rod 25 and in a threaded end cap 40 which is engaged with the threaded end 37 of tube 36. The head 35 is retained from turning on the rod 25 by a set screw 41 in threaded engagement in the tube 36 and in a keyway recess 42 in rod 25.

The rod 25 at the end opposite to end cap 40 bears against the end 45 of a tubular reinforcing member 46.

The rod 25 is spaced from an interior shoulder 47 of the tube 36 with a bore 48 of tube 36 therebeyond which bore carries the core reinforcing member 46.

The member 46 is hollow and detachably retained in bore 48 by a shear pin 50 which extends transversely across the tube 36 and member 46.

The force exerted on end 45 of reinforcing member 46 is determined by positioning end cap 40 to provide a preload force on shear pin 50.

The tube 25 is hollow and adjacent the portion 32 has an interior bore 51 which contains a ball check valve 52 urged into seating engagement with a shoulder 53 in bore 51 by a spring 54 which is retained at its opposite end in bore 51 by a hollow plug 56 in threaded engagement in interior threads 57 of the tube 25.

The ball check valve 52 prevents grout and water from rod 27 being forced back which grout or water may be used to wash out the bore hole 16 and to pre fill the hole.

The member 46 also carries a piston disc 60 and a piston cup 61 slidably mounted thereon engaging the member 46 and free to move therealong within tube 11.

The tube 11 is closed by the head 14 in threaded engagement with tube 36 which head has teeth 66 on its end to engage the soil and resist rotation of the outer tube 11 and head 14.

The head 14 carries within it plug 68 which plug 68 has a bore 69 with an O-ring 70 in groove 71 which engages the core reinforcing member 46.

An additional O-ring 72 is provided in an exterior groove 73 in plug 68 between it and head 14 for slip fit retention of plug 68 in head 14. The space 64 between piston disc and cup 60 and 61 and the plug 68 provides a space for storage of grout for subsequent delivery.

The head 14 has a cavity 74 therein which may receive grout when extruded from the space 64 as will be explained below and the head 14 also has external teeth 75 thereon to engage the sides of and stabilize it in the bore 16.

The member 46 is provided with grout delivery holes 76 and 77 to permit more grout to be delivered because of the pressure of the piston disc 60 and cup 61 into the interior of the tube 46 and therefrom to the exterior of the tube 46 and may flow to the space 74, as hereinafter explained.

The assembly 10 when desired to be used and subsequent to the boring of a large diameter hole 16 to the location where sampling is to begin and a smaller diameter hole 17 therebelow to the desired depth of sample has the space 64 charged with grout which can be portland cement, gypsum cement, and epoxy resin or other suitable binder and filler selected according to the soil conditions.

The head 14 is removed from tube 36, grout is supplied to the space 64 and piston 61 is positioned along reinforcing member 46 depending on the quantity of grout to be delivered. The head 14 is replaced on tube 36 and the carrier 10 lowered into position by means of equipment (not shown) attached to orienting rod 26 and 27 until teeth 66 engage the soil.

The rod 26 is rotated to free the threaded portion 31 from engagement with the threaded portion 22 and thereby permit rod 25, shear head assembly 35 and member 46 to move downwardly within the tube 11.

Figure 2:
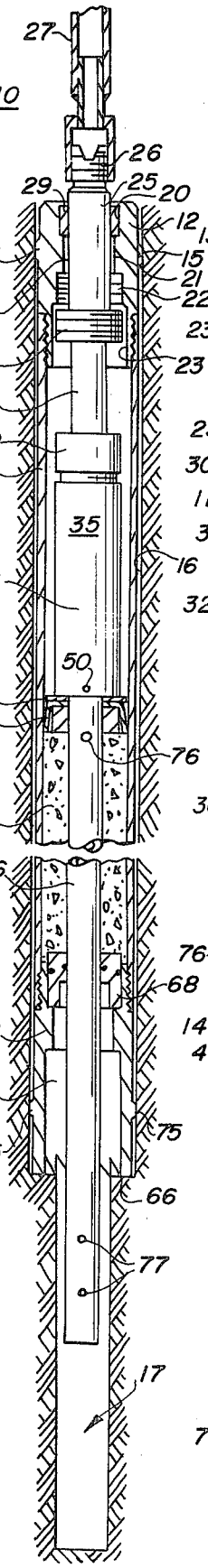
FIG. 2 is a view similar to FIG. 1 but showing the apparatus in another position.
Figure 3:
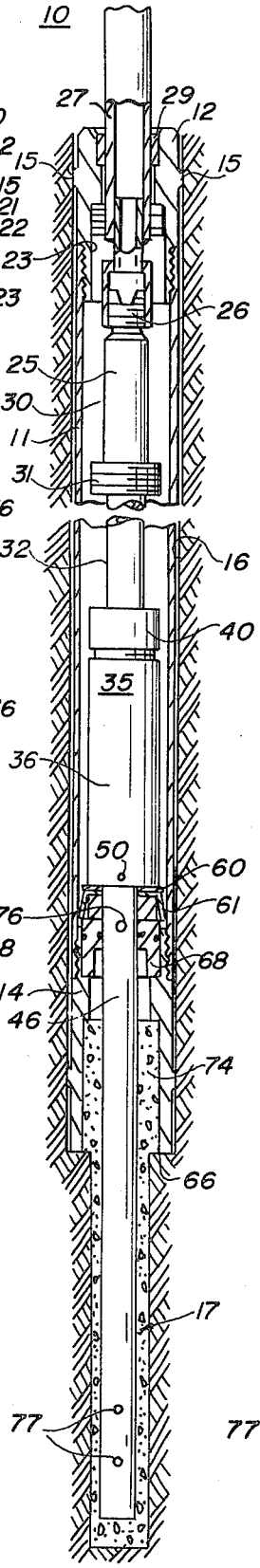
FIG. 3 is a view similar to FIG. 1 and showing the apparatus in still another position.

When assembly 35 moves from the position shown in FIG. 1 to that shown in FIG. 2 it contacts piston disc 60 and cup 61 so that the hole 76 is positioned inside the space 64 and grout can now flow or be forced thereinto and out holes 77 as the assembly moves downwardly into the hole 17. When piston cup 61 strikes the plug 68 the pin 50 is sheared and member 46 is disengaged from the assembly 35. The carrier 10 can then be removed from the bore hole 16.

It should be noted that the rods 26 and 27 can be rotated to orient member 46 in hole 17 prior to shearing of pin 50.

Figure 4:
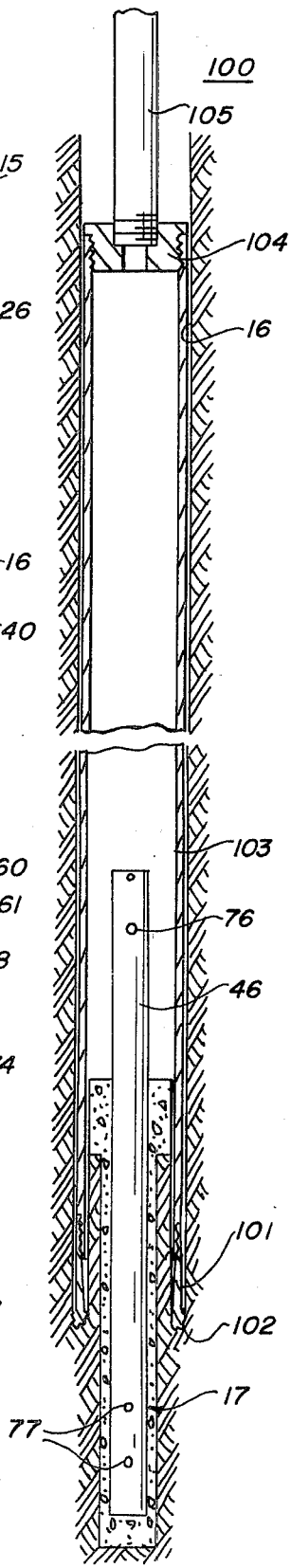
FIG. 4 is a vertical sectional view showing the overcoring for recovery of the core sample.

As shown in FIG. 4, a core drill 100 of well known type which includes a cutting head 101 with cutters 102, a core barrel 103, and lug 104 and rod 105 for rotation is lowered into the hole until it engages the end of the larger diameter hole 16. The drill 100 is rotated to drive the head 101 to the desired depth. Upon completion of this drilling operation the drill 100 is drawn upwardly and the mass of soil, rock, and grout, with the tube 46 are recovered in conventional manner for core samples.

The operation can be repeated as desired with varying lengths of tube 46 and charges of grout depending on the soil and rock conditions and length of the core sample to be recovered.

I claim:

1. Grout injecting apparatus for delivering grout into a cavity below the surface of the ground comprising an outer elongated tubular member for insertion into a portion of said cavity, an orienting member extending within said tubular member and detachably connected thereto, an inner elongated tubular member in surrounding relation to said orienting member and having an elongated hollow core reinforcing member separably secured thereto, grout retaining and delivery control members mounted on said core reinforcing member for delivery of preloaded grout into a portion of said cavity, and a head at the lower end of said elongated tubular member detachable for grout loading.

2. Grout injecting apparatus as defined in claim 1 in which said core member is detachably connected to said inner elongated tubular member by a shear member.

3. Grout injecting apparatus as defined in claim 2 in which a shear head assembly is provided interposed between said inner tubular member and said core member, and members are provided within said shear head assembly for preloading said shear member.

4. Grout injecting apparatus as defined in claim 3 in which said grout retaining and delivery control members comprise a piston slidably mounted in said outer tubular member, means for urging said piston downwardly for delivery of grout to said core member, and means for controlling the movement of said shear head assembly.

5. Grout injecting apparatus as defined in claim 4 in which said first mentioned means comprises a threaded connection.

6. Grout injecting apparatus as defined in claim 4 in which the movement of said shear head assembly controls the shear member.

7. Grout injecting apparatus as defined in claim 1 in which said grout retaining and delivery members include a closure plug closing one end of said outer elongated tubular member.

8. Grout injecting apparatus as defined in claim 7 in which said closure plug has a space therein open at the bottom for reception of grout.

9. Grout injecting apparatus as defined in claim 1 in which said core reinforcing member is hollow and is provided with openings for reception of grout and for delivery of grout into the cavity upon the movement of said core member openings downwardly past said piston.

10. Grout injecting apparatus as defined in claim 1 in which said outer elongated tubular member has a head assembly on the lower end thereof, said head assembly has an interior chamber open at the bottom for advancement downwardly of said core member and for reception of grout, said head assembly having teeth on the lower end thereof for engagement to resist rotation and for aiding in activation of said grout retaining and delivery members.

* * * * *

UNITED STATES PATENT OFFICE
CERTIFICATE OF CORRECTION

Patent No. 3,986,536 Dated October 19, 1976

Inventor(s) Leroy W. Janson

It is certified that error appears in the above-identified patent and that said Letters Patent are hereby corrected as shown below:

Column 4,

Line 9, after "and" (first occurrence) "lug" should be - plug -

Signed and Sealed this

Fourteenth Day of December 1976

[SEAL]

*Attest:*

RUTH C. MASON
*Attesting Officer*

C. MARSHALL DANN
*Commissioner of Patents and Trademarks*